United States Patent [19]

Wooten et al.

[11] Patent Number: 4,466,644

[45] Date of Patent: Aug. 21, 1984

[54] MULTI-POSITIONING LATCH ASSEMBLY

[75] Inventors: Ronald E. Wooten, Sunnymead; John Lehne, Hacienda Heights; Gerald A. Kwan, Pasadena, all of Calif.

[73] Assignee: LeVan Specialty Co., Inc., City of Industry, Calif.

[21] Appl. No.: 340,291

[22] Filed: Jan. 18, 1982

[51] Int. Cl.[3] ..... E05C 17/34

[52] U.S. Cl. ..... 292/263; 292/DIG. 5

[58] Field of Search ..... 292/263, 103, 204, DIG. 5

[56] References Cited

U.S. PATENT DOCUMENTS 1,228,012 5/1917 Forth ..... 292/263 X 4,120,524 10/1978 Buck, Jr. ..... 292/263

FOREIGN PATENT DOCUMENTS 2408889 9/1975 Fed. Rep. of Germany ..... 292/263

*Primary Examiner*—Richard E. Moore

*Attorney, Agent, or Firm*—Francis X. LoJacono

[57] ABSTRACT

A multi-positioning latch assembly adapted for use with hinged panels, and more particularly for use in combination with a hinged glass panel and the related fixed frame structure, such as employed in sunroof-window structures for vehicles, wherein the assembly comprises a first link member defining a latch handle and a second link member defining a toggle-latch arm, the adjacent ends of the first and second link members being provided with cooperating position-engaging members. The toggle-latch arm is pivotally attached at one end to the fixed frame structure and at the other end to the latch handle, the opposite end of the latch handle being pivotally attached to the hinged panel, whereby the panel can be locked into any one of several open positions or a closed position.

10 Claims, 7 Drawing Figures

MULTI-POSITIONING LATCH ASSEMBLY

BACKGROUND OF THE INVENTION

1. Field of the Invention

This invention relates generally to latching devices for movable panels, and more particularly to a multi-positioning latch assembly which provides a means to lock a hinged panel in one of several positions ranging from closed to fully opened.

2. Description of the Prior Art

Many types of latching devices are presently being used for opening and closing hinged panels. However, most of the known latching devices are not suitable or compatible in providing means for establishing several open positions in a very simple and positive manner, particularly with respect to hinged glass panels employed in combination with sunroof fixtures.

Various problems and difficulties have been encountered in providing a multi-position latch device and, until the present invention was devised, most latching devices have been very complicated to use and expensive to manufacture, their designs also not allowing for a long useful operating life. Most latching devices employed in association with hinged-panel sunroofs allow the selection of only two basic positions—fully opened or fully closed, such as illustrated in U.S. Pat. Nos. 3,974,753 and 4,257,632.

SUMMARY OF THE INVENTION

The present invention has for an important object to provide a simple multi-position latch assembly having means interposed between a pair of hinged toggle linkages, whereby a hinge panel can be latched in several open positions as well as in a fully closed or a fully opened position.

It is another object of the present invention to provide a multi-position latch mechanism which comprises a first toggle linkage defining a latch handle having one pivot end adapted to be pivotally secured to a hinged panel, and an opposite pivot end adapted to be pivotally connected to a second toggle linkage, wherein a selective positioning means is defined by opposing projecting keeper members which are interposed between the adjacent connected ends of the linkages.

It is still another object of the invention to provide a device of this character which includes a selective-positioning member that allows a hinged panel or window to be selectively positioned in a fully closed and locked mode, as well as in several intermediate open modes.

It is a further object of the present invention to provide a device of this character which is relatively simple to operate, and inexpensive to manufacture and maintain in operational condition over a substantial period of time.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
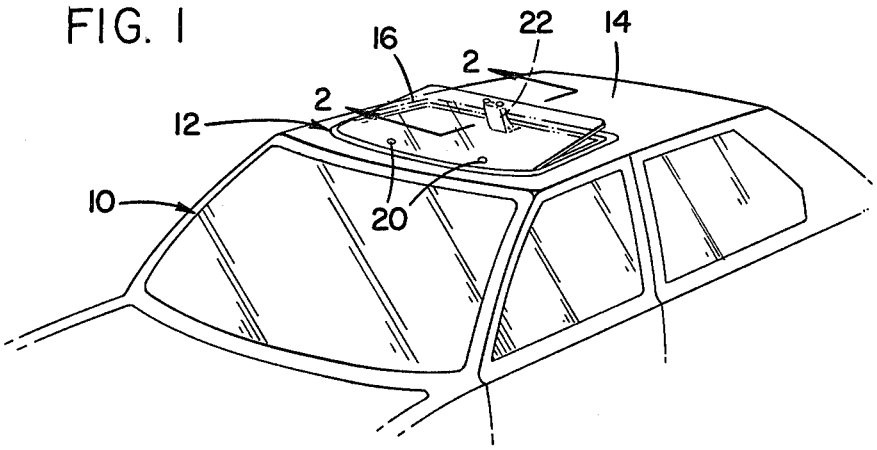
FIG. 1 is a pictorial view of a portion of a vehicle having a sunroof mounted therein, indicating the location of the present invention thereon.

Referring more particularly to FIG. 1, there is shown a portion of a vehicle such as an automobile, generally indicated at 10, wherein a roof-vent unit, designated at 12 and known as a sunroof, is installed and mounted in an opening provided in the vehicle roof wall 14. When mounted, sunroofs are generally positioned so as to be located directly over the driver and passenger front-seat areas, and they extend transversely across the major portion of the width of the roof 14.

However, the present invention is adapted to be employed with various other types of hinged panels and is not necessarily restricted to sunroofs, as will be readily understood from the following detailed description thereof.

Figure 3:
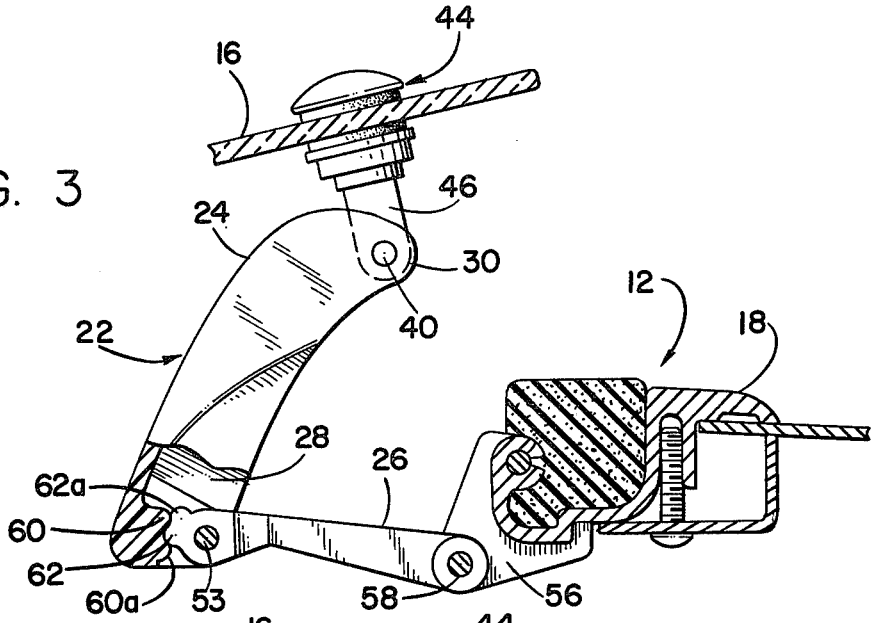
FIG. 3 is a similar cross-sectional view of the latch assembly in a second open position.
Figure 4:
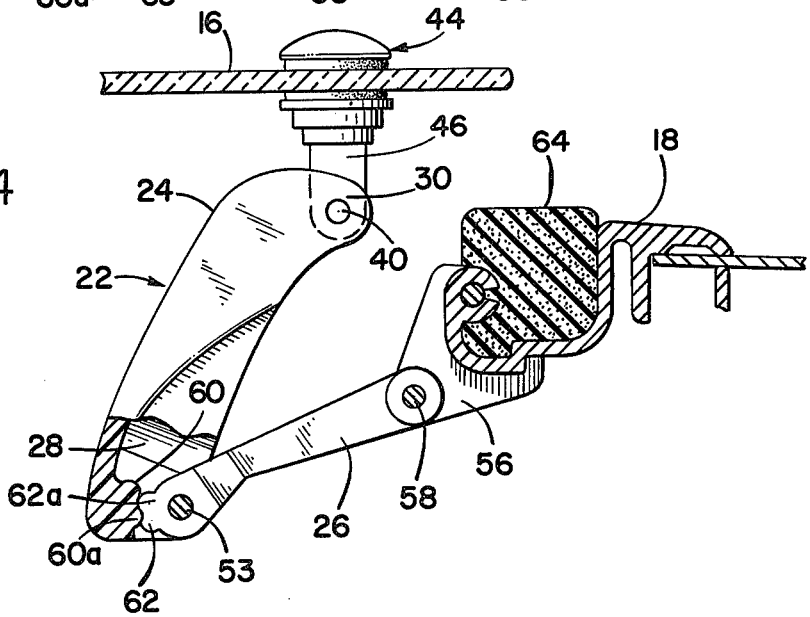
FIG. 4 is a cross-sectional view, showing the latch assembly in a third open position.
Figure 5:
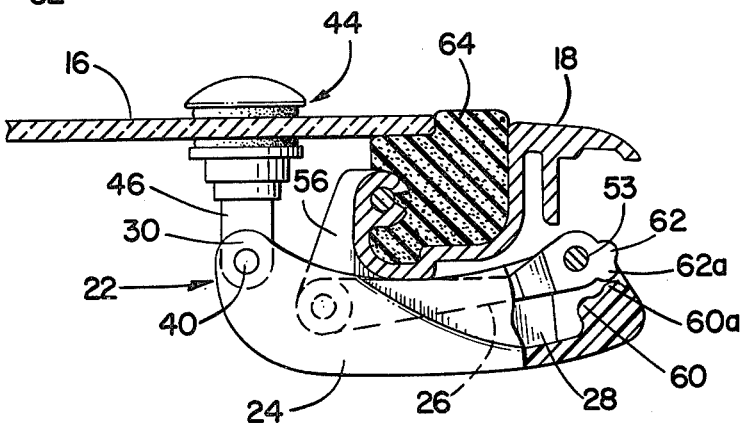
FIG. 5 is a cross-sectional view, showing the latch assembly locked in a fully closed position.

Accordingly, the window panel 16 is hingedly mounted to a substantially rectangular frame structure 18 which is fixedly attached to roof 14 of the vehicle. Hinge means represented at 20 are located along the forward edge of unit 12, and they interconnect frame 18 and panel 16, in order to allow panel 16 to open to a venting position when the latching mechanism, generally indicated at 22, is actuated and released from a locking position, as indicated in FIG. 5, to any one of the desired open positions, as in FIGS. 2, 3 and 4.

Since the hinge members are not part of the present invention and are not specifically shown, it should be noted that any suitable hinge means can be employed therewith.

As for the multi-positioning latch mechanism 22, one or more may be employed by locating each latch mechanism 22 along the trailing or rearward portion of the sunroof 12, as illustrated. Thus, the latching mechanism of the present invention is so designed as to latch the associated panel in a sealed-closed position, and when actuated further allows the panel to be positioned at several selective open modes.

The multi-positioning latch mechanism comprises a toggle-jointed latch having a pair of toggle-link members, the first toggle-link member being defined by a toggle-jointed latch-handle member 24, and the second toggle-link member being defined by a toggle-arm member 26. The members 24 and 26 are provided with an articulated joint by means of pivot pin 28, which allows a geniculating action between latch handle 24 and toggle arm 26, whereby toggle arm 26 is foldable within handle 24 when in a closed mode, as illustrated in FIG. 4.

Latch handle 32 comprises a channel-shaped housing having at its upper end a pair of ear members 30 defined by slot 34. Bores 36 are disposed through the ear members so as to receive a pivot pin 40, thus establishing a connecting pivot means between latch handle 24 and a mounting bracket 44.

Mounting bracket 44 may consist of any suitable bracket adapted to be secured to panel 16 having an extended lug member 46 which is formed to be received in slot 34 of handle 24. The end of lug 46 includes a hole to receive pin 40, whereby handle 24 is pivotally connected to panel 16.

Channel housing 28 of handle 24 includes side flanges 50 having oppositely disposed holes 52 formed therein to receive toggle pin 53, thereby pivotally connecting toggle arm 26 to handle 32, the arm 26 having bore 54 adapted to align with holes 52. The opposite end of the toggle arm 26 is also provided with a bore 55 which is arranged to be pivotally connected to the fixed frame 18 by means of bracket 56, which is secured to frame 18 in a suitable manner, whereby pivot pin 58 passes through bracket 56 and bore 55 of arm 26.

The hinged panel is secured in the various selective positions between a locked-closed mode to a fully open mode by a positioning means interposed between the cooperating pivotal ends of the latch-handle member 24 and the toggle arm member 26. Transversely disposed between side flanges 50 and integrally formed as part of the handle housing is a pair of projecting rib members 60 and **60*a* arranged to engage oppositely disposed rib members 62 and 62*a* formed on the cooperating end of arm 26**.

Referring to FIG. 5, panel 16 is shown in a locked-closed mode, the panel being held in place against a suitable seal member 64. Latch handle 24 is positioned in a substantially horizontal arrangement, with the toggle arm being geniculated so as to be received in handle housing 28. In this position, rib **60*a* of handle 24 engages rib 62*a* of toggle arm 26**, thus securing the assembly in a locked position.

FIG. 4 illustrates the first open mode of panel 16, with the handle 24 extending substantially upward and the toggle arm 26 extending angularly outward, whereby rib **60*a* of handle 24 is locked between ribs 62 and 62*a*, and rib 62*a* is locked between ribs 60 and 60*a*. When handle 24 is pulled downwardly and outwardly from a closed position, rib 62*a* snaps into the above position, thus locking panel in a slightly open mode. Conversely, when handle 24 is moved further to the position illustrated in FIG. 3, panel 16 is raised higher, providing a greater space between the panel and the frame or seal 64, and rib 62*a* is forced over rib 60—rib 62 being located between ribs 60 and 60*a***.

Figure 2:
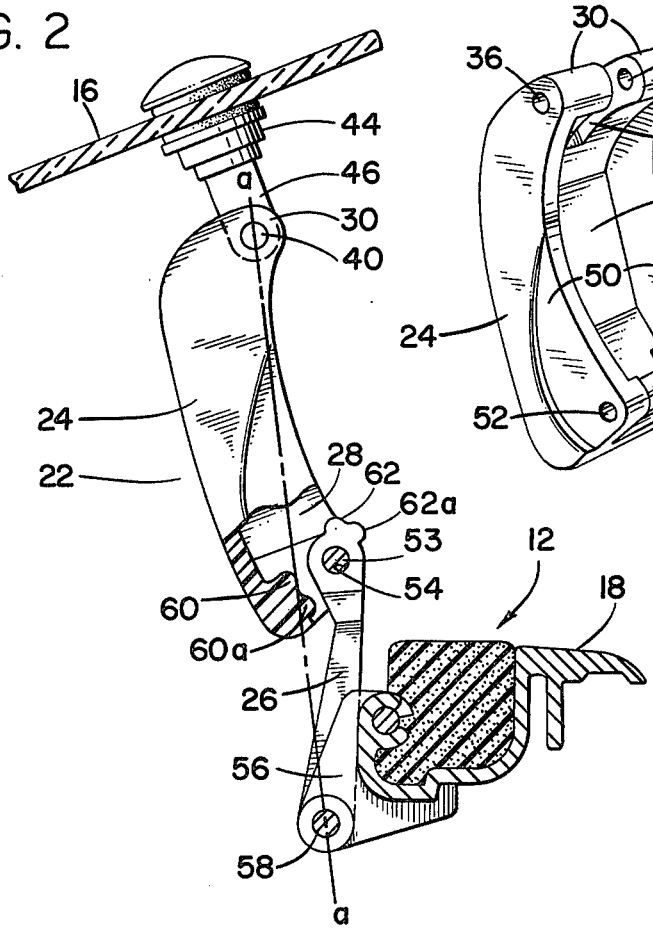
FIG. 2 is an enlarged cross-sectional view of the present multi-position latch assembly taken substantially along line 2—2 of FIG. 1, showing the latch securing the sunroof hinged panel in a fully opened position.
Figure 6:
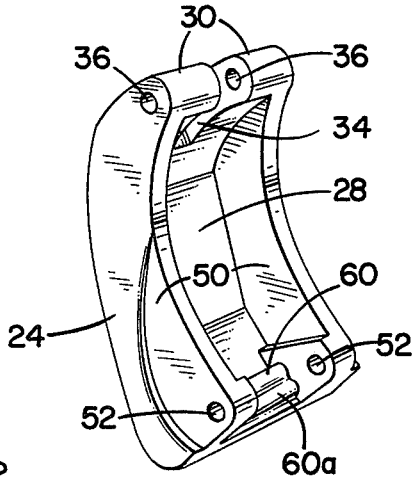
FIG. 6 is a perspective view of the latch handle.
Figure 7:
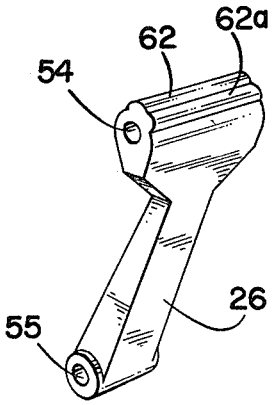
FIG. 7 is a perspective view of the toggle-latch arm.

FIG. 2 illustrates the panel 16 in a fully open mode, the latch-handle 24 being positioned in an upwardly inclined arrangement and toggle arm 26 being in a vertically upright position. Hence, the downward force of panel 16 causes latch handle 24 to push toggle arm 26 against frame 18 at a fixed position, whereby pin 53 is positioned to the far side of centerline a—a which is defined by the relative positions of pins 40 and 58, when the latch assembly is in a fully open mode.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and we do not wish to be restricted to the specific form shown or uses mentioned, except as defined in the accompanying claims.

We claim:

1. A multi-positioning latch assembly for a hinged closure panel having a fixed frame, wherein the assembly comprises:

a latch-handle member having a first attaching end and a second attaching end;

means for pivotally attaching said latch handle to said panel, said means being pivotally attached to said first attaching end thereof;

a toggle arm having first and second pivotally attaching ends, said first attaching end being pivotally connected to said second end of said latch handle;

a bracket means secured to said fixed frame, said second attaching end of said toggle arm being pivotally connected thereto; and means formed between said latch handle and said toggle arm for selectively positioning said panel between an intermediate open position and a fully closed locked position;

wherein said positioning means comprises:

a first pair of projection members formed on the second attaching end of said latch handle; and a second pair of projection members formed on said first attaching end of said toggle arm, said first and second pairs of projections being adapted to engage each other for selective positioning of said panel.

2. A multi-positioning latch assembly as recited in claim 1, wherein said first pair of projections is formed as contiguous transverse rib members.

3. A multi-positioning latch assembly as recited in claim 1, wherein said second pair of projections is formed as contiguous transverse rib members.

4. A multi-positioning latch assembly as recited in claim 1, wherein said first and second pairs of projections are formed as contiguous transverse rib members; and wherein pivot means is provided at each pivotal connection to allow articulate movement of said latch assembly, when any one of the multi-positions is selected.

5. A multi-positioning latch assembly as recited in claim 4, wherein said latch handle includes oppositely disposed side flanges defining a housing to receive said toggle arm therein in a folded position.

6. A multi-positioning latch assembly for a hinged closure panel having a fixed frame, wherein the assembly comprises:

a latch-handle member having a first attaching end and a second attaching end;

means for pivotally attaching said latch handle to said panel, said means being pivotally attached to said first attaching end thereof;

a toggle arm having first and second pivotally attaching ends, said first attaching end being pivotally connected to said second end of said latch handle;

means for pivotally securing said second attaching end of said toggle arm to said fixed frame; and means formed between said latch handle and said toggle arm for selectively positioning said panel between an intermediate open position and a fully closed locked position;

wherein said positioning means comprises:

at least one projection member formed adjacent said second attaching end of said latch handle; and a plurality of projection members formed on said first attaching end of said toggle arm, said projection members of said toggle arm being adapted to engage said projection member of said latch handle for selective positioning of said panel.

7. A multi-positioning latch assembly as recited in claim 6, wherein said projection members of said toggle arm extend outwardly thereof in a radial manner, so as to rotate about the axis of said first attaching end of said toggle arm.

8. A multi-positioning latch assembly as recited in claim 6, wherein said projections are formed as extended rib members.

9. A multi-positioning latch assembly as recited in claim 6, wherein said projection members are formed as extended juxtaposed rib members; and wherein pivot means is provided at the pivotal connection between said latch handle and said toggle arm, to allow articulate movement of said latch assembly, when any one of the multi-positions is selected.

10. A multi-positioning latch assembly as recited in claim 9, wherein said latch handle includes oppositely disposed side flanges defining a housing to receive said toggle arm therein in a folded position, and wherein said projection member thereof is interposed between said side flanges.

* * * * *